United States Patent [19]

Yonker et al.

[11] 4,026,363

[45] May 31, 1977

[54] APPARATUS AND METHOD FOR PERFORMING A DESIRED OPERATION AT A SPECIFIED LOCATION IN A WELL

[75] Inventors: John H. Yonker, Carrollton; Phillip S. Sizer, Dallas, both of Tex.

[73] Assignee: Otis Engineering Corporation, Dallas, Tex.

[22] Filed: Dec. 9, 1975

[21] Appl. No.: 639,093

[52] U.S. Cl. ..... 166/315; 166/117.5; 166/156; 166/255

[51] Int. Cl.[2] ..... E21B 23/02; E21B 23/04

[58] Field of Search ..... 166/315, 117.5, 117.6, 166/156, 214, 215, 255

[56] References Cited

UNITED STATES PATENTS

| | | | |
|---|---|---|---|
| 2,673,614 | 3/1954 | Miller | 166/214 |
| 3,268,006 | 8/1966 | Hayes | 166/315 X |
| 3,353,607 | 11/1967 | Kinley | 166/117.5 |
| 3,638,723 | 2/1972 | Carroll | 166/215 |
| 3,670,821 | 6/1972 | Tamplen | 166/315 |
| 3,727,693 | 4/1973 | Tausch et al. | 166/315 |
| 3,732,928 | 5/1973 | Sizer | 166/156 X |
| 3,837,398 | 9/1974 | Yonker | 166/117.5 |
| 3,874,445 | 4/1975 | Terral | 166/117.5 |
| 3,888,306 | 6/1975 | Wetzel | 166/255 |

*Primary Examiner*—Stephen J. Novosad
*Attorney, Agent, or Firm*—Vinson & Elkins

[57] ABSTRACT

An apparatus and method for performing a desired operation in a selected mandrel in a well. The apparatus includes a running assembly with selector stop means and operating tool means. The running assembly is run in the tubing string until the selector stop means positively locates it with respect to the selected mandrel. The operating tool means can then be manipulated to perform the desired operation in the selected mandrel. This abstract is neither intended to define the invention of the application which, of course, is measured by the claims, nor is it intended to be limiting as to the scope of the invention in any way.

5 Claims, 8 Drawing Figures

APPARATUS AND METHOD FOR PERFORMING A DESIRED OPERATION AT A SPECIFIED LOCATION IN A WELL

BACKGROUND OF THE INVENTION a. Field of the Invention

This invention relates to a method and apparatus for performing a desired operation in a selected mandrel of a well having a tubing string and at least one mandrel at an intermediate location in the tubing string. More particularly this invention relates to a running assembly including operating tool means to perform the desired operation and selector stop means to positively locate the operating tool means with respect to the selected mandrel. The apparatus is constructed so that once the selector stop means locates the operating tool means, manipulation of the operating tool means to perform the desired operation disengages the selector stop means. Additionally, this invention relates to a method of utilizing a running assembly to positively locate operating tool means with respect to a selected mandrel when the tubing string has at least one mandrel at an intermediate location in the string, and from that location, manipulating the operating tool means to perform the desired operation in a selected mandrel.

b. The Prior Art

A well is often equipped with at least one mandrel in which an operaion will be performed at an intermediate position within the tubing string. Generally a plurality of such mandrels are positioned within the tubing string and an identical operation may be performed in each mandrel. A single type of operating tool means may be utilized. To perform the operation in the proper mandrel the location of the tool must be known.

When wire line equipment is employed, it is possible to determine the location of the operating tool means with respect to any selected mandrel by measuring the length of the line that has been paid out.

Where pumpdown equipment is utilized no satisfactory method of determining the position of the operating tool has been available. Conventionally, two types of systems are used to ascertain the location of a pump down running assembly. Both systems are unable to positively locate the running assembly in intermediate positions in the tubing string.

One system attempts to locate the running assembly by measuring the amount of fluid pumped into the well. Inaccurate locations are calculated with this system because of fluid seepage past the pump down locomotives and because of trapped gases in the column of pumped fluids.

In the second conventional system, a plurality of nipples with a restrictive bore are placed in the tubing string. The running assembly is temporarily impeded when passing through such a nipple. The purpose of impeding movement of the running assembly is to create a registrable increase in fluid pressure. Unfortunately, such nipples also contribute to the hanging up of the running assembly. In addition, they do not provide a good indication of where the running assembly is located because it may also hang up on other obstructions in the tubing. Such an unintended hangup provides a pressure increase similar to the pressure increase which occurs when the running assembly passes through a restrictive bore nipple.

Thus, at depths in excess of several thousand feet, it is presently impossible to accurately locate the pumpdown running assembly in the drill string. As mandrels are often positioned within a couple of hundred feet of each other, the error associated with locating a pump down running assembly means that the operator is unable to ascertain if the running assembly is in the vicinity of a selected mandrel in which he wants to perform a desired operation or if it is in the vicinity of some other mandrel. Performing the operation in the wrong mandrel, at the very least, means that the running assembly has to be removed from the well, redressed, and rerun in an attempt to perform the operation in the selected mandrel, all at a considerable waste of time and expense. Other consequences of performing the operation in the wrong mandrel, such as killing the well, killing the wrong zone, treating the wrong zone, or allowing two zones to communicate with each other, are much more serious.

Some running assemblies include a locator tool means. The locator tool means carries locator keys which are matched with the internal recess of a predetermined locator nipple. Upon movement of the running assembly through the well tubing, the locator keys engage the recess of the predetermined locator nipple to position the running assembly. With the locator keys remaining in position, pins are sheared and/or telescoping sleeves moved to permit operation of the work tool. The locating tool means may be left in the tubing along with a work tool, as disclosed in U.S. Pat. No. 2,673,614 to Miller, or the locating tool means may be removed from the tubing leaving a locked tool similar to the "Model 'A' Locking Device" and "Model 'B' Locator Tool" disclosed in a Harold Brown Company brochure entitled "Wireline Production Equipment for Flow and Pressure Control". In either event, by positioning different locator keys on the locator tool means, the running assembly is located at a different locator nipple. Problems with such systems are that the operation is performed with the locator keys engaging the locating nipple, the keys interfere with the operation of the work tool, the amount and type of manipulations that may be made to the work tool are limited, and the work tool must employ a combination of shear pins and/or large telescoping sleeves to perform the desired operation.

Occasionally, even with a wireline, due to operator inattentiveness or a malfunction of the line counter, the running assembly may overshoot the desired operating mandrel. The running assembly then must be relocated in the well before the desired operation may be performed.

OBJECTS OF THE INVENTION

It is an object of this invention to provide a method and apparatus for locating a pumpdown or wireline running assembly with respect to a selected mandrel at an intermediate position within the well from which location the running assembly may be moved to permit performance of the desired operation in the selected mandrel.

It is a further object of this invention to provide a means for locating a pumpdown running assembly within a tubing from which location the running assembly is moved so that, (i) the locating means does not interfere with the performance of the operation, (ii) the amount and type of manipulations of a work tool is not limited, and (iii) the work tool is not limited to a combination of shear pins and/or large telescoping sleeves to perform the desired operation.

Additionally, it is an object of this invention to provide a method of performing a desired operation in a selected mandrel of a well wherein the pumpdown running assembly is positively located and then moved to a second position where the work tool can be manipulated to perform the desired operation.

These and other objects, features, and advantages of this invention will be apparent from the drawings, the detailed description, and the appended claims.

BRIEF DESCRIPTION OF THE DRAWINGS

In the drawings wherein like numerals indicate like parts and wherein illustrative embodiments of this invention are shown.

DESCRIPTION OF THE PREFERRED EMBODIMENT

Figure 1:
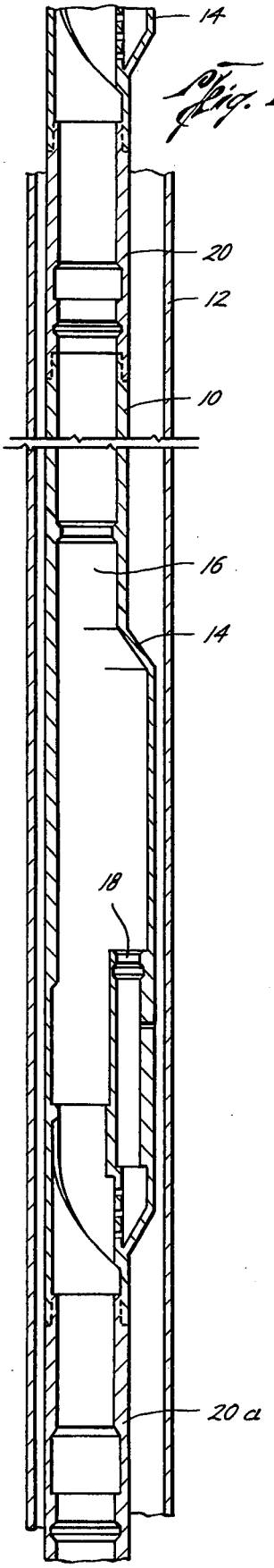
FIG. 1 is a fragment and sectional view of a well tubing and casing string having a plurality of stop nipples and side pocket mandrels.
Figure 2:
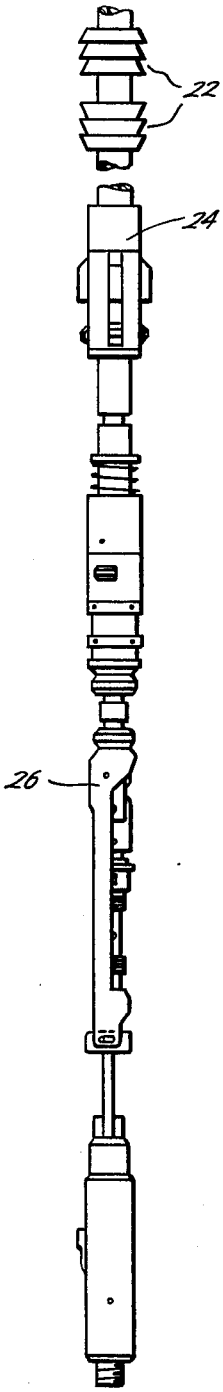
FIG. 2 is a view in elevation of a running assembly including selector stop means and kickover tool means.

A tubing string 10 is normally run with at least one mandrel at an intermediate location in the tubing string, in which it will be desired to perform an operation. The tubing string 10 will be in a casing 12 of a well for producing fluids.

When the well is equipped to employ gas lift recovery, a plurality of mandrels, such as side pocket mandrels 14, may be provided in the tubing string 10. The side pocket mandrel 14 includes a bore 16 extending therethrough of generally the same size and aligned with the bore of the tubing string 10. The mandrel 14 also includes a side pocket receptacle 18 for receiving and retaining equipment. The side pocket mandrel 14 engages an operating tool means, commonly known as a kickover tool means, during the installation or retrieval of equipment from the side pocket receptacle 18. When, as illustrated, there are more than one side pocket mandrel 14 in the tubing string 10, on a single run of the kickover tool means, one piece of equipment is installed or retrieved from a selected side pocket mandrel 14.

Means are provided in the tubing sting 10 to selectively cooperate with means on the running assembly to positively locate the running assembly with respect to at least one of the intermediately spaced mandrels 14. The selective, cooperable, locating means in the tubing string 10 is a stop nipple 20 such as that disclosed in U.S. Pat. No. 2,673,614 to Miller; such patent being hereby incorporated by reference for all purposes. When, as illustrated, a plurality of mandrels 14 are positioned at spaced locations within the tubing string 10, a plurality of stop nipples 20 are preferably also positioned at spaced locations within the tubing string 10. To provide a means for selectively locating the running assembly with respect to different mandrels 14 each stop nipple 20 is positioned with respect to a different one of the mandrels 14 and each stop nipple 20 is positioned a known distance from at least one of the mandrels 14. It will be apparent that a single nipple 20 might be utilized to locate more than one mandrel 12 when the mandrels are sufficiently close together.

Although the operational tools can be run into the well on a conventional wireline, or the like, they will be herein described as being moved in and out of the well by pumped fluids as in conventional pump down operations.

The running assembly to be run in the tubing string 10 includes pump down locomotive means 22, selector stop means 24, and operating tool means 26.

The illustrated pump down piston locomotive means 22 is conventional in form and connected to the selector stop means 24 but it is to be understood that the locomotive means 22 could be attached to either or both of the operating tool means 26 and the selector stop means 24. The pumpdown locomotive means 22 may be a pair of oppositely facing swab cups obtainable from TRW Mission in Houston, Texas. The attachment may be through a set of jars (not shown) so that a jarring force may be applied during the manipulation and operation of the operating tool means 26. The pump down locomotive means 22 is responsive to the action of fluid pumped in the tubing string 10 to move the running assembly in either direction through the tubing string 10.

The selector stop means 24 cooperates with a selected stop nipple 20 to limit the movement of the running assembly in one direction through the tubing string 10. The stopping of the running assembly by the cooperation of selector stop means 24 and the selected stop nipple 20 positively locates the running assembly with respect to the selected mandrel 14. The illustrated selector stop means 24 and nipple 20 are the same as those shown in the aforesaid U.S. Patent to Miller. Different key configurations and mating nipples permit the stop means to land in selected nipples. (Note that the recesses in nipple 20 and **20*a* are different lengths and a key designed to fit nipple 20*a* will not fit nipple 20**).

The illustrated operating tool means 26 is a kickover tool means. The kickover tool means 26 is identical to the kickover tool disclosed in U.S. Pat. No. 3,837,398 to John H. Yonker, the entire disclosure of which is hereby incorporated by reference. The kickover tool means operates, in the manner described in the aforesaid patent, to install or retrieve equipment from the side pocket receptacle 18 of side pocket mandrels 14.

Means are provided for connecting together the operating tool means 26 and the selector stop means 24. The connecting means spaces the operating tool means 26 a sufficient distance from the selector stop means 24 so that the selector stop means 24 is disengaged from the selected stop nipple 20 when the operating tool means 26 is in a position to coact with the selected mandrel 14 to effect operation of the operating tool means 26. The operating tool means 26 and the selector stop means 24 are thus connected together such that when the selector stop means 24 has engaged a selected stop nipple 20, the distance between the operating tool means 26 and the selector stop means 24 is less than the distance between the selected stop nipple 20 and the selected mandrel 14. The connecting means may be a separate sub connecting the operating tool means 26 with the selector stop means 24, or alternatively, each of the operating tool means 26 and the selector stop means 24 may have means, such as interconnecting threads, for connecting one to the other.

Referring now to FIGS. 3 through 6, the method in which equipment is installed or retrieved from one selected mandrel 14 of the well will be described.

The running assembly is made up to include the pump down locomotive means 22, the selector stop means 24 and the kickover tool means 26. Although there may be a plurality of stop nipples in the tubing string 10, the selector stop means is designed to cooperate only with one selected stop nipple 20.

The running assembly is run downward through the tubing string 10 by fluid pressure. Dummy valves (not shown) will block flow through all mandrels above the working mandrel. Thus flow will pass through the working mandrel to a circulating port (not shown) provided below the lowermost side pocket mandrel or other landing nipple, sliding sleeve or the like (not shown), which is to cooperate with the tool string 26. The pumped fluids flow through such port into the casing-tubing annulus to return to the surface. Since the selector stop means and nonselected stop nipple are not designed to cooperate with each other, the running assembly may be run past any number of such nonselected stop nipples 20. In this manner the running assembly is run through the tubing string 10 past side pocket mandrels 14 in which it is not desired to install or retrieve equipment.

Figure 3:
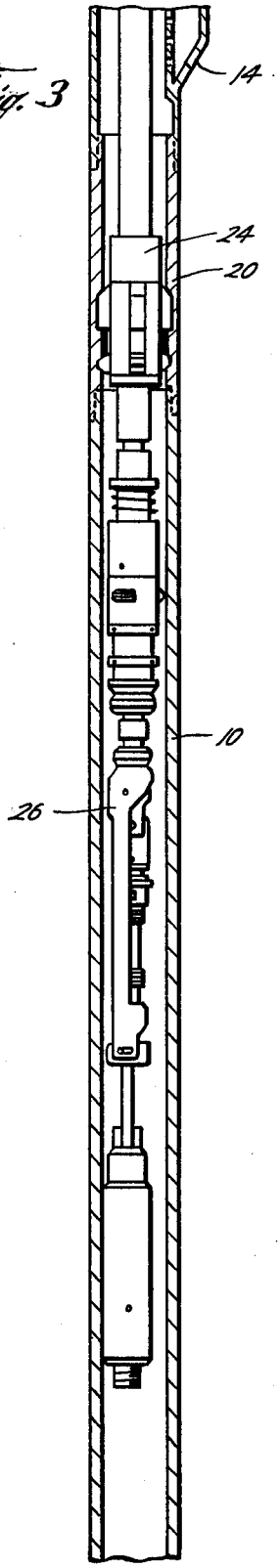
FIGS. 3, 4, 5, and 6 are a series of views, partially in elevation and partially in section, showing running and manipulation of the selector stop means and the kickover tool means of FIG. 2 to install equipment in a specified side pocket mandrel.

When the running assembly is attempted to be run through the one selected stop nipple 20, the selector stop means 24 cooperates with the stop nipple 20 to stop further downward movement of the running assembly. At this time the pumpdown locomotive means 22 is above the selected mandrel 14 while the kickover tool means has been run past the operating location of the selected mandrel 14 and is in an inoperable position within the tubing string 10. However, the kickover tool means 26 is positively located a known distance below the selected mandrel 14. The stopping of the downward movement of the running assembly to positively locate the kickover tool means 24 with respect to side pocket mandrel 12 is depicted in FIG. 3. Now, by utilizing a given sequence of manipulations, the kickover tool means 26 can engage the side pocket mandrel 12 to perform the desired operation therein.

Figure 4:
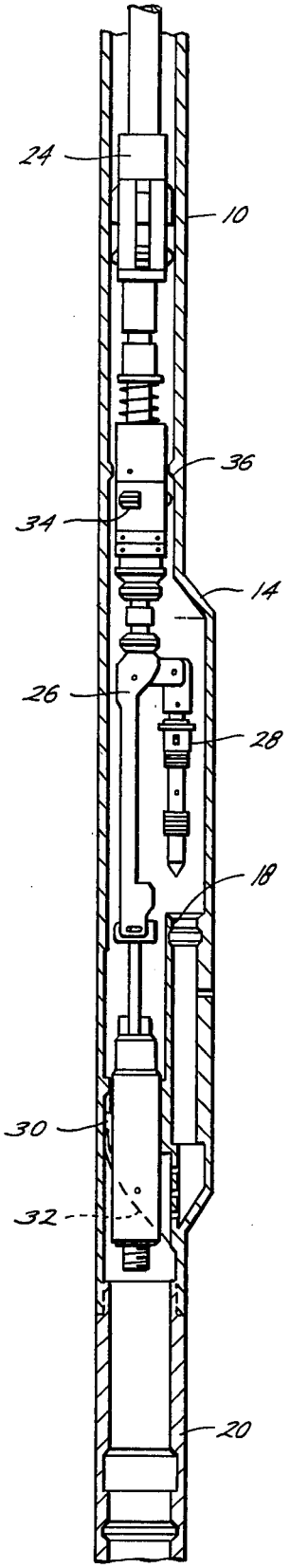

To manipulate the kickover tool means, fluid pressure is applied to the casing-tubing annulus and the tubing at the surface is opened to permit the stop means 24 to disengage from the stop 20 nipple and the running assembly is moved upwardly in the tubing string 10 until the kickover tool is actuated as it becomes positioned in the selected mandrel 14 in the usual manner with respect to the side pocket 18 and is run downwardly again to install equipment 28 in the side pocket as illustrated in FIG. 4.

If desired,, while the kickover tool means 26 is being run upward, it can be oriented by the engagement of locator key means 30 with an orienting sleeve means 32 in the tubing string 10. The orienting of the kickover tool means 26 orients the kickover tool means 26 with respect to the side pocket receptacle of the selected side pocket mandrel 14.

While the kickover tool means 26 is engaging the selected side pocket mandrel 14 to install or retrieve equipment, the selector stop means 24 remains disengaged from the selected stop nipple 20. With the selector stop means 22 thus disengaged, the selector stop means does not interfere with the performance of the operation, the manipulations to operate the kickover tool means 26 are not limited, and a kickover tool means rather than a work tool having only a combination of shear pins and/or telescoping sleeves can be employed.

Figure 5:
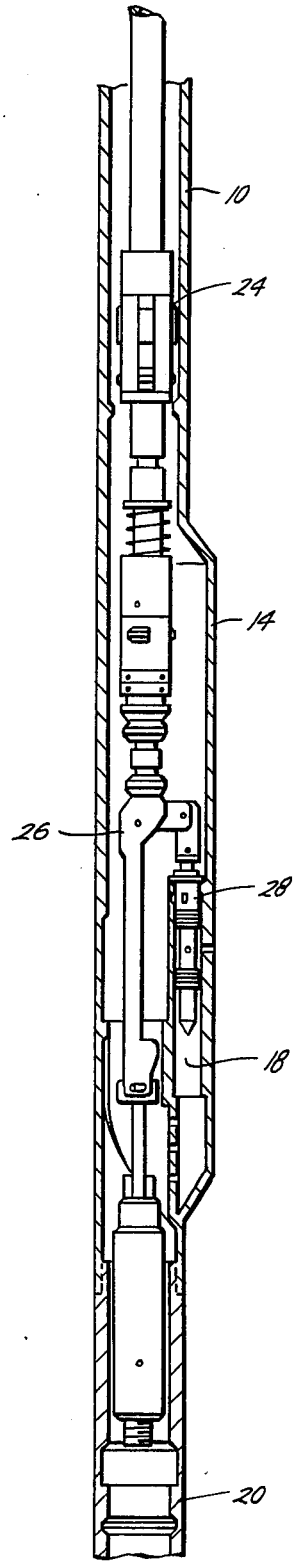
Figure 6:
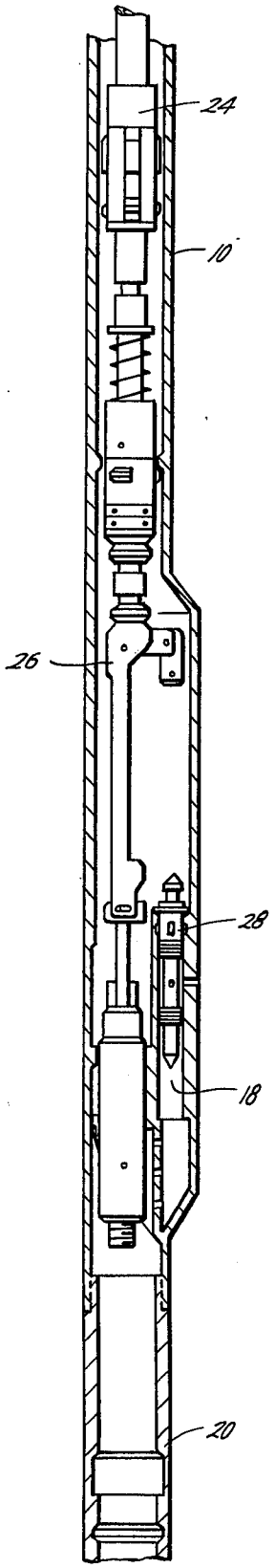

FIGS. 4, 5 and 6 show the manipulation of the kickover tool means 26 disclosed in the aforesaid U.S. Pat. No. 3,837,398 to install equipment 28 in the side pocket receptacle 18 of the selected mandrel 14. As disclosed in the aforementioned patent, manipulation of the kickover tool means 26 to install equipment 28 includes moving the tool upward through the tubing until the dog means 34 associated with said kickover tool means 26 engages stop means 36 in the tubing string 10. A continued upward application of force actuates or activates the kickover tool means 26. The kickover tool means 26 may then start its downward motion (See FIG. 4) and is moved downwardly until equipment 28 is installed in the side pocket receptacle 18 as shown in FIG. 5. Once the equipment 28 is installed, the kickover tool means 26 can be removed from the tubing string 10 by movement in an upward direction as shown in FIG. 6.

Figure 7:
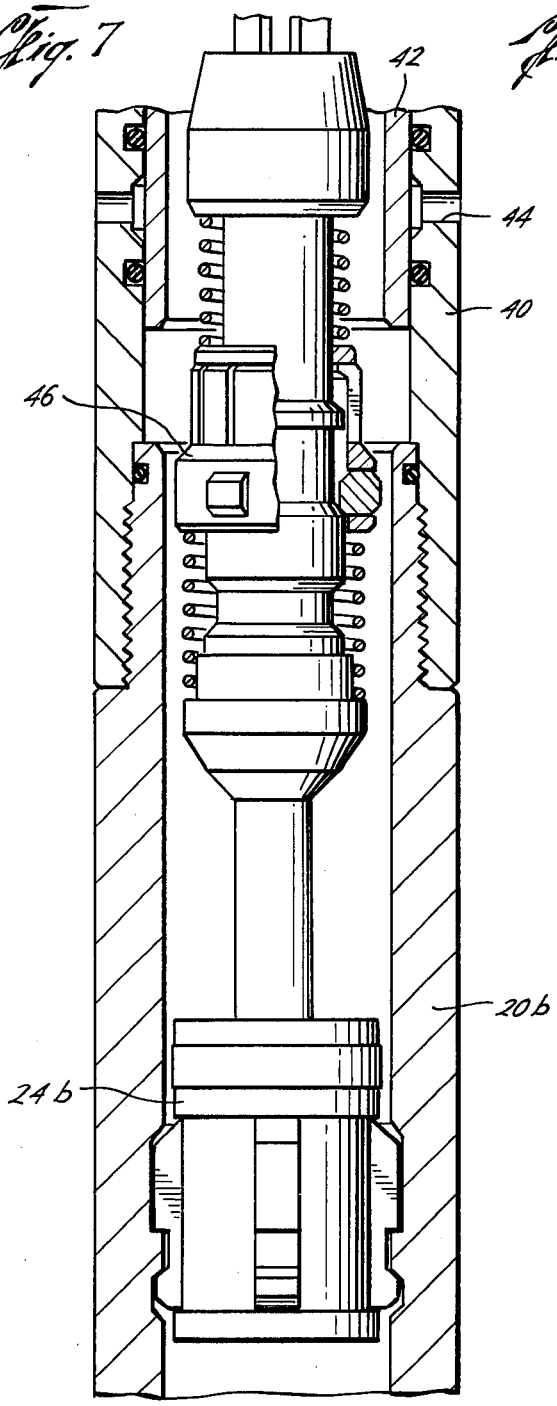
FIG. 7 is a view in elevation of a running assembly including selector stop means and operating tool means adapted to shift a sleeve valve means in the tubing string.

Mandrels, other than side pocket mandrels, may be positioned at intermediate locations in the well tubing string. For example, the tubing string 38 could include at least one mandrel 40 (FIGS. 7 and 8) with a shifting sleeve valve means comprising a sleeve 42 and port means 44. The mandrel 40 with its shifting valve means could be the same as that disclosed in U.S. Pat. No. 3,638,723 issued Feb. 1, 1973 to Albert W. Carroll; the disclosure of said patent being hereby incorporated by reference for all purposes.

To selectively locate a running assembly with respect to any such intermediately positioned mandrel 40, the well would also include at least one stop nipple **20*b* as previously described. The stop nipples 20*b* would be positioned a known distance from at least one of the mandrels 40 and each such stop nipple would be positioned with respect to a different mandrel 40**.

The running assembly would then include a pump down locomotive means, selector stop means **24*b*, and operating tool means 46**.

The pump down locomotive means is conventional and in conjunction with fluid being pumped through the tubing string 38 operates to transport the running assembly in either direction through the tubing string 38.

The selector stop means **24*b* is designed to be cooperable with the stop nipple 20*b*** to selectively limit movement of the running assembly in one direction through the tubing string.

The operating tool means 46 may be the shifting tool disclosed in the aforesaid U.S. Pat. No. 3,638,723. It is designed to perform the operation of shifting sleeve 42 of mandrel 40.

The operating tool means 46 and the selector stop means **24*b* are connected together so that when the selector stop means 24*b* is cooperating with the selected stop nipple 20*b* to positively locate the running assembly, the operating tool means 46 is not engaging mandrel 40 to shift sleeve 42. However, when the operating tool means 46 is engaging mandrel 40 to shift sleeve 42 the selector stop means 24*b* no longer cooperates with nipple 20***b* but is instead disengaged from the nipple.

Figure 8:
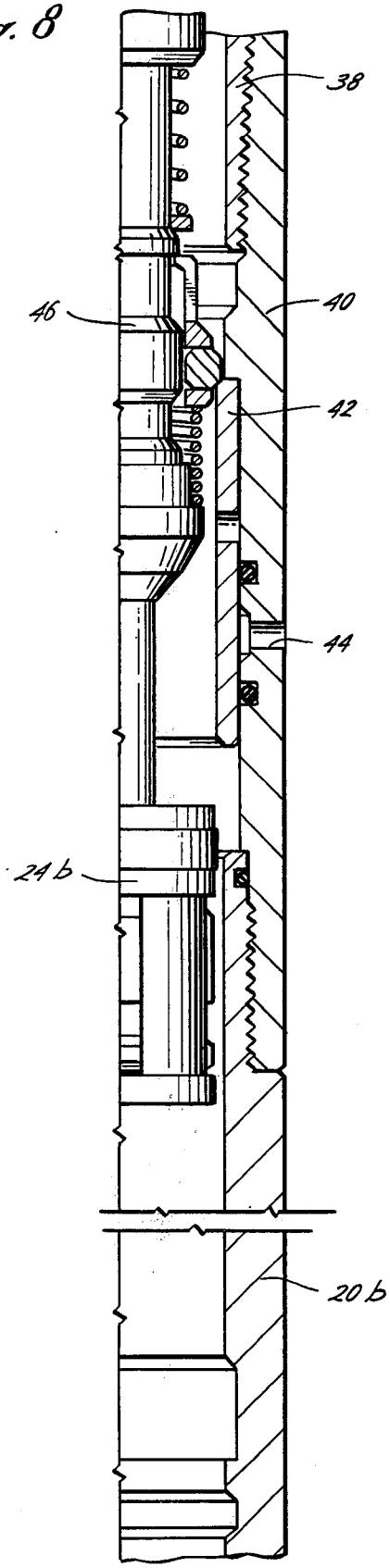
FIG. 8 is a view partially in elevation and partially in section of the selector stop means and operating tool means of FIG. 7 in position to shift a sleeve valve means in the tubing string.

To perform the operation of shifting a sleeve in a selected mandrel 40, the running assembly is run downward through the tubing string 38 by circulating fluid. The selector stop means 24*b* cooperates with the selected stop nipple 20*b* to limit the downward movement of the running assembly. This positively locates the running assembly with respect to the selected mandrel 40. From this location, the running assembly is moved upwardly by reverse circulation until the operating tool means 46 passes sleeve 42. In passing sleeve 42, the shifting tool means 46 is activated to its operative position. The operating tool means 46 is then circulated downward to engage selected mandrel 40 to shift sleeve 42 down as shown in FIG. 8. While the operating tool means 46 is engaging mandrel 40 it can be seen that the selector stop means 24*b* is disengaged from the selected stop nipple 20*b*. (FIG. 8)

It can thus be appreciated that a novel method and apparatus combination has been provided to enable a pumpdown running assembly to perform a desired operation in any selected mandrel.

Mandrels in addition to the illustrated side pocket mandrels 14 and the shifting sleeve valve mandrels 40, may be employed in accordance with this invention. The mandrels may be any type of mandrel in which a desired operation is performed. The operations include inserting equipment, retrieving equipment, opening a valve, closing a valve, shifting a sleeve, etc. The operating mandrel would include appropriate components to engage the operating tool means to perform the desired operation. A plurality of identical mandrels may be positioned at spaced locations in the tubing string. The desired operation may be performed in any one of the mandrels without performing it in others.

The stop nipples may be any means in the well that can cooperate with means on the running assembly to selectively stop movement of the running assembly through the well in one direction. At least one stop nipple is provided and it is positioned a known distance from a selected mandrel. Preferably, as many stop nipples as mandrels are provided. Then each stop nipple may be positioned a known distance from a different one of the mandrels.

The selector stop means of the running assembly is then any means that can cooperate with and engage the stop nipples to limit further movement of the running assembly in one direction through the well. It does not limit movement of the running assembly in the other direction through the well. Indeed, the running assembly is moved in said other direction once it is positively located by the cooperating engagement of the selector stop means and the stop nipple to position the operating tool means in the vicinity of the selected mandrel.

The operating tool means is any tool that will perform the desired operation. The tool may be universal, that is, the tool can be one that can perform the operation in all of the mandrels. It is then the combination of the stop nipple and the running assembly having a selector stop means and the operating tool means which enables the desired operation to be performed in a selected one or more mandrels. The operating tool means and the selector stop means are connected together so that when the selector stop means is cooperating with the stop nipple to positively locate the running assembly the operating tool means is not engaging the selected mandrel and cannot perform the desired operation. However, when the operating tool means is engaging the selected mandrel and is performing the desired operation the selector stop means no longer cooperates with and engages the stop nipple. In this manner the manipulations that may be made to the operating tool means is not limited, nor is the design of the operating tool means limited.

It can be seen from the foregoing that the objects of this invention have been obtained. An apparatus has been provided which enables a running assembly to be selectively located in the well but which does not limit the type of manipulations nor construction of an operating tool means. A method of performing a desired operation in a selected mandrel in a well has been provided whereby a running assembly is located and from which location is moved to another location to permit operating tool means to perform a desired operation.

The foregoing disclosure and description of the invention are illustrative and explanatory thereof and various changes in the size, shape and materials, as well as in the details of the illustrated construction may be made within the scope of the appended claims without departing from the spirit of the invention.

What is claimed is:

1. An apparatus for performing a desired operation in a selected mandrel in a well, the well having a tubing string and the apparatus comprising:

at least one mandrel positioned at an intermediate location in the tubing string, one of which is the selected mandrel in which the desired operation will be performed;

at least one stop nipple having an internal recess of a selected configuration and positioned a known distance from at least one of said mandrels;

a running assembly including:

selector stop means cooperable with a selected stop nipple to positively locate said running assembly upon movement of said running assembly through the tubing string in a first direction with respect to the selected mandrel, said selector stop means including key means having an outer configuration to mate with the inner configuration of said selected stop nipple to effect said locating, operating tool means for performing the desired operation, means on said operating tool means adapted to coact with the selected mandrel after movement through the tubing in a second direction to locate said operating tool means in a location to perform the desired operation, said operating tool means performing said desired operation upon a subsequent movement of the operating tool means in said first direction through the tubing string after movement in said second direction and being retrievable through the tubing string after performance of the desired operation, means connecting said selector stop means and said operating tool means with said operating tool means being spaced a sufficient distance from said selector stop means so that said selector stop means is disengaged from said selected stop nipple when said operating tool means is in a position to coact with the selected mandrel to effect operation of said operating tool means, and pumpdown locomotive means for moving the running assembly through the tubing string;

whereby said selector stop means locates the operating tool means upon movement of said running assembly in a first direction through the tubing from which location said operating tool means may be manipulated to perform the desired operation at said selected mandrel.

2. An apparatus for performing a desired operation in a selected mandrel in a well, the well having a tubing string and at least one mandrel at an intermediate location in the tubing string with one of said mandrels being the selected mandrel in which the desired operation will be performed, the apparatus comprising:

at least one stop nipple having an internal recess of a selected configuration and positioned a known distance from at least one of the mandrels;

a running assembly including:

selector stop means cooperable with a selected stop nipple to positively locate said running assembly upon movement of said running assembly through the tubing string in a first direction, said selector stop means including key means having an outer configuration to mate with the inner configuration of said selected stop nipple to effect said locating, operating tool means for performing the desired operation, means on said operating tool means adapted to coact with the selected mandrel after movement through the tubing in a second direction to locate said operating tool means in a position to perform the desired operation, said operating tool means performing said desired operation upon a subsequent movement of the operating tool means in said first direction through the tubing string after movement in said second direction and being retrievable through the tubing string after performance of the desired operation, means connecting said selector stop means and said operating tool means with said operating tool means being spaced sufficient distance from said selector stop means so that said selector stop means is disengaged from said selected stop nipple when said operating tool means is in a position to coact with the selected mandrel to effect operation of the operating tool means, and pumpdown locomotive means for moving the running assembly through the tubing string;

whereby said stop selector locates the operating tool means upon movement of said running assembly in one direction through the tubing string from which location said operating tool means may be manipulated to perform the desired operation in the selected mandrel.

3. An apparatus for installing or retrieving equipment from selected side pocket mandrel in a well tubing string, the apparatus comprising:

at least one side pocket mandrel positioned at an intermediate location in the tubing string, with one of said side pocket mandrels being the selected mandrel in which the desired operation will be performed;

at least one stop nipple having an internal recess of a selected configuration and positioned in the tubing string a determined distance from at least one of said side pocket mandrels;

a running assembly including:

kickover tool means adapted to be actuated in one of said side pocket mandrels after movement in an upward direction through the tubing string, adapted to install or retrieve equipment from said side pocket mandrel upon a subsequent movement in a downward direction after actuation and adapted to be retrieved through the tubing string after equipment has been installed or retrieved from said side pocket mandrel upon a subsequent movement in an upward direction, selector stop means cooperable with a selected stop nipple to limit movement of the running assembly in a downward direction, said selector stop means including key means having an outer configuration to mate with the inner configuration of said selected stop nipple, means connecting said kickover tool means and said selector stop means with said selector stop means positioned in the running assembly above said kickover tool means, and pumpdown locomotive means for moving the running assembly through the tubing string;

whereby said selector stop means positively locates said kickover tool means below a selected side pocket mandrel upon downward movement of the running assembly through the tubing string from which location the kickover tool means can be manipulated to install or retrieve equipment from the selected side pocket mandrel.

4. An apparatus for installing or retrieving equipment from a selected side pocket mandrel in a well, the well having a turing string, at least one side pocket mandrel at an intermediate location in said tubing string with one of said side pocket mandrels being the selected mandrel, and also having orienting sleeve means in the tubing string associated with each of said side pocket mandrels, and the apparatus comprising:

at least one stop nipple having an internal recess of a selected configuration and positioned in the tubing string a determined distance from at least one of the side pocket mandrels;

a running assembly including:

kickover tool means adapted to be articulated into the side pocket of the side pocket mandrels after movement in an upward direction through the tubing string, adapted to install or retrieve equipment from said side pocket mandrel after actuation upon a subsequent movement in a downward direction, and adapted to be retrieved through the tubing string after equipment has been installed or retrieved from said side pocket mandrel upon a subsequent movement in an upward direction, said kickover tool means including orienting means adapted to engage the orienting sleeve means associated with said selected side pocket mandrel for orienting said kickover tool means with respect to said selected side pocket mandrel, selector stop means cooperable with a selected stop nipple to limit movement of the running assembly in a downward direction said selector stop means including key means having an outer configuration to mate with the inner configuration of said selected stop nipple, means connecting said kickover tool and said selector stop means with said selector stop means positioned in the running assembly above said kickover tool means, and pumpdown locomotive means attached to at least one of said kickover tool means and said selector stop means;

whereby said selector stop means positively locates said kickover tool means below a selected side pocket mandrel on downward movement of the running assembly through the tubing string from which location the kickover tool means can be manipulated to install or retrieve equipment from the selected side pocket mandrel.

5. The method of performing a desired operation in a selected mandrel in a well comprising the steps of:

running a running assembly in one direction through a well tubing string having at least one mandrel at an intermediate location therein, one of which is the selected mandrel, and at least one stop nipple positioned a determined distance from at least one of said mandrels, engaging selector stop means associated with the running assembly with a selected stop nipple to limit further movement of the running assembly in said one direction through the well tubing string a known distance from the selected mandrel, running the running assembly in a second direction in the well tubing string until operating tool means associated with the running assembly is in position to effect the desired operation in the selected mandrel, operating the operating tool means within the selected mandrel to perform the desired operation including the step of moving the assembly in said first direction to perform the desired operation, and retrieving the running assembly from the well by running the running assembly through the well tubing.

* * * * *